US005568771A

United States Patent [19]

Brochand

[11] Patent Number: 5,568,771

[45] Date of Patent: Oct. 29, 1996

[54] DETACHABLE GRIP FOR COUPLING CARS OR CHAIRS OF A GONDOLA LIFT OR CHAIRLIFT

[75] Inventor: Max Brochand, Noyarey, France

[73] Assignee: Pomagalski S.A., France

[21] Appl. No.: 518,491

[22] Filed: Aug. 23, 1995

[30] Foreign Application Priority Data

Sep. 8, 1994 [FR] France ..... 94 10936

[51] Int. Cl.[6] ..... B61B 7/00

[52] U.S. Cl. ..... 104/206; 104/209; 104/216

[58] Field of Search ..... 104/204, 205, 104/206, 209, 216, 229

[56] References Cited

U.S. PATENT DOCUMENTS

| | | | |
|---|---|---|---|
| 3,037,464 | 6/1962 | Penney et al. | 104/209 |
| 4,441,430 | 4/1984 | Brochand | 104/209 |
| 4,653,406 | 3/1987 | Levi | 104/216 |
| 5,111,751 | 5/1992 | Zlotek | 104/209 |

FOREIGN PATENT DOCUMENTS

| | | |
|---|---|---|
| 0174701 | 3/1986 | European Pat. Off. . |

*Primary Examiner*—S. Joseph Morano
*Attorney, Agent, or Firm*—Parkhurst, Wendel & Burr, L.L.P.

[57] ABSTRACT

A detachable grip of a gondola lift or chairlift has a movable jaw urged towards a fixed jaw by a pair of compression springs. The movable jaw is rigidly secured to one end of an operating lever, which pivots in a vertical plane containing the grip body to control the opening or closure onto the cable of the jaws. One end of the springs is secured near the free end of the operating lever, opposite to the movable jaw, and the other end of the springs is secured near the fixed jaw. The mutual distance of the spring ends near the fixed jaw is higher than the mutual distance of the spring ends near the the free end of the operating lever, so that the springs are twice inclined with respect to the grip body.

5 Claims, 1 Drawing Sheet

DETACHABLE GRIP FOR COUPLING CARS OR CHAIRS OF A GONDOLA LIFT OR CHAIRLIFT

BACKGROUND OF THE INVENTION

The invention relates to a detachable grip for coupling loads, such as cars or chairs of a gondola lift or chairlift, to a continuously moving cable of an aerial monocable transport installation. The detachable grip comprises a grip body extending transversely on one side of the cable in the coupled position and having a pivot or articulation of a load support hanger shifted laterally of the cable, and cable clamping jaws comprising a fixed jaw secured to the grip body and a movable jaw pivotally mounted onto the fixed jaw. A grip control mechanism includes an operating lever having one end rigidly secured to the movable jaw to control its opening or closure onto the cable when the lever pivots in a first plane containing the grip body. A pair of compression coil springs are symmetrically disposed laterally on each side of the first plane and act on the operating lever to urge the movable jaw towards the fixed jaw in a cable clamping position. U.S. Pat. No. 4,441,430 describes such a grip which may remain fixed to the cable on the line during the night and which can still be safely and efficiently uncoupled and coupled to the cable notwithstanding ice or snow. A problem resides in the structural complexity of that grip. The springs are inserted between the free end of the operating lever, opposite to the movable jaw, and a support bracket rigidly secured to the free end of the grip body, opposite to the fixed jaw. The spring forces are exerted on this free end of the grip body and its consequent dimensions are large.

SUMMARY OF THE INVENTION

The object of the present invention is to provide a very simple grip, which insures a reliable coupling to the cable even in ice or snow.

The grip according to the invention is characterized in that one of the ends of the springs is secured near the free end of the operating lever, opposite to the movable jaw, that the other end of the ends of the springs is secured near the fixed jaw, that the two springs extend within a second plane, which is perpendicular to the first plane containing the grip body and the operating lever, and which is inclined with respect to a direction of extension of the grip body, and that the mutual distance of the spring ends near the fixed jaw is higher than the mutual distance of the spring ends near the free end of the operating lever. The spring forces act on the grip body near the fixed jaw and near the load support hanger articulation and it is easy to see that the forces are concentrated in that zone, which is accordingly shaped and sized.

According to a development of the invention the ends of the springs near the fixed jaw are secured to a support bar, which extends transversely to the grip body and supports guiding wheels adapted to ride on tracks in the stations. At the entrance of a station the grip is uncoupled from the cable and the wheels run on a transfer rail in a well known manner. The wheels and the spring fixing points are near the ends of the support bar, which is inserted between the fixed jaw and the hanger articulation. Another wheel is secured to the free end of the grip body. The free end of the operating lever supports a roller which travels along a guide rail (not shown) located at the entrance of the station to move the operating lever downwards against the action of the springs for opening the jaws and uncoupling the grip from the cable. In the same way the jaws are closed for coupling the grip to the cable at the station exit.

The distance between the spring fixing points near the fixed jaw is higher than the size of the hanger articulation, so that the springs extend on each side of that articulation, adjacent to the fixed jaw. The spring fixing points near the fixed jaw are at the level of the the grip body and the springs extend upwards above the grip body in a direction twice inclined with respect to the grip body direction. The spring action on the operating lever is modulated by the inclinations of the springs and is adapted to the actuating force.

Braking and acceleration of the uncoupled grip may be provided by wheels frictionly acting on a plate secured to the upper side of the transverse support bar, which supports the guiding wheels.

DESCRIPTION OF THE PREFERRED EMBODIMENT

The invention will be further described, by way of example, with reference to the accompanying drawings, in which.

Figure 1:
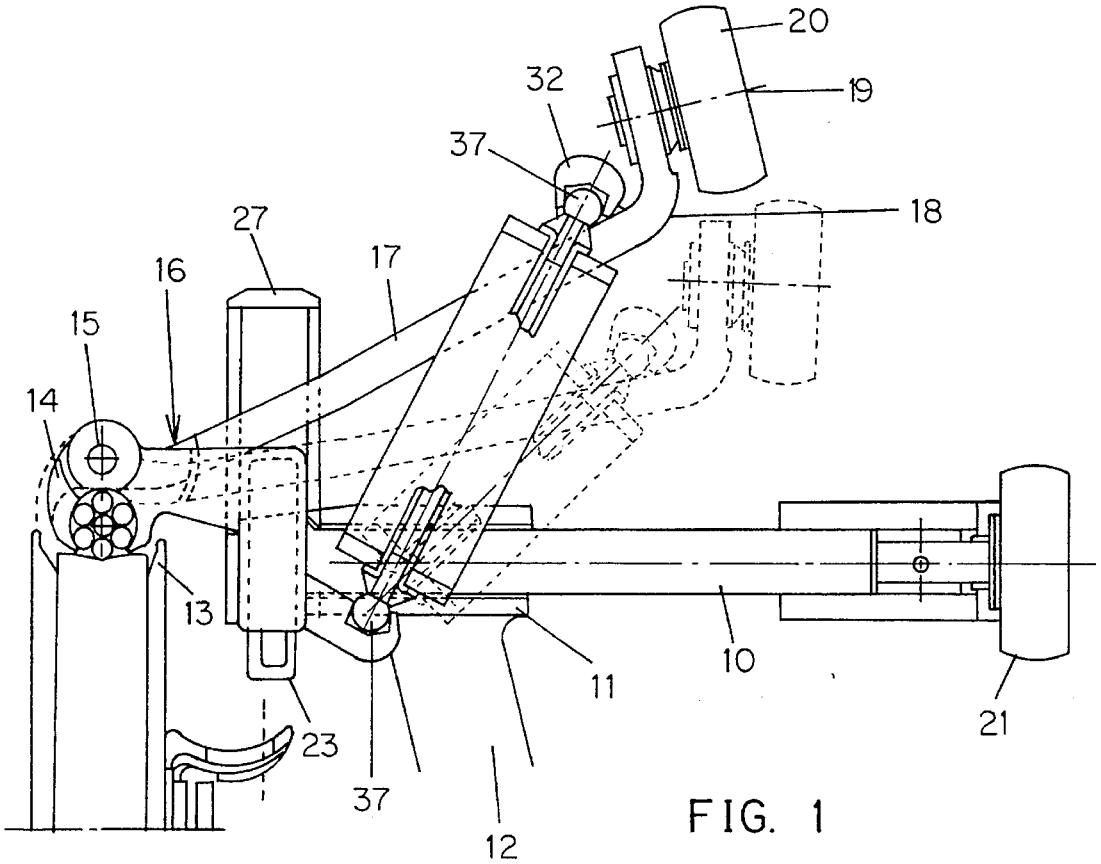
FIG. 1 is a schematic elevational view, partially in cross section, of a grip in accordance with the invention, shown, in full line, in the closed position and, in dotted line, in the opened position.
Figure 2:
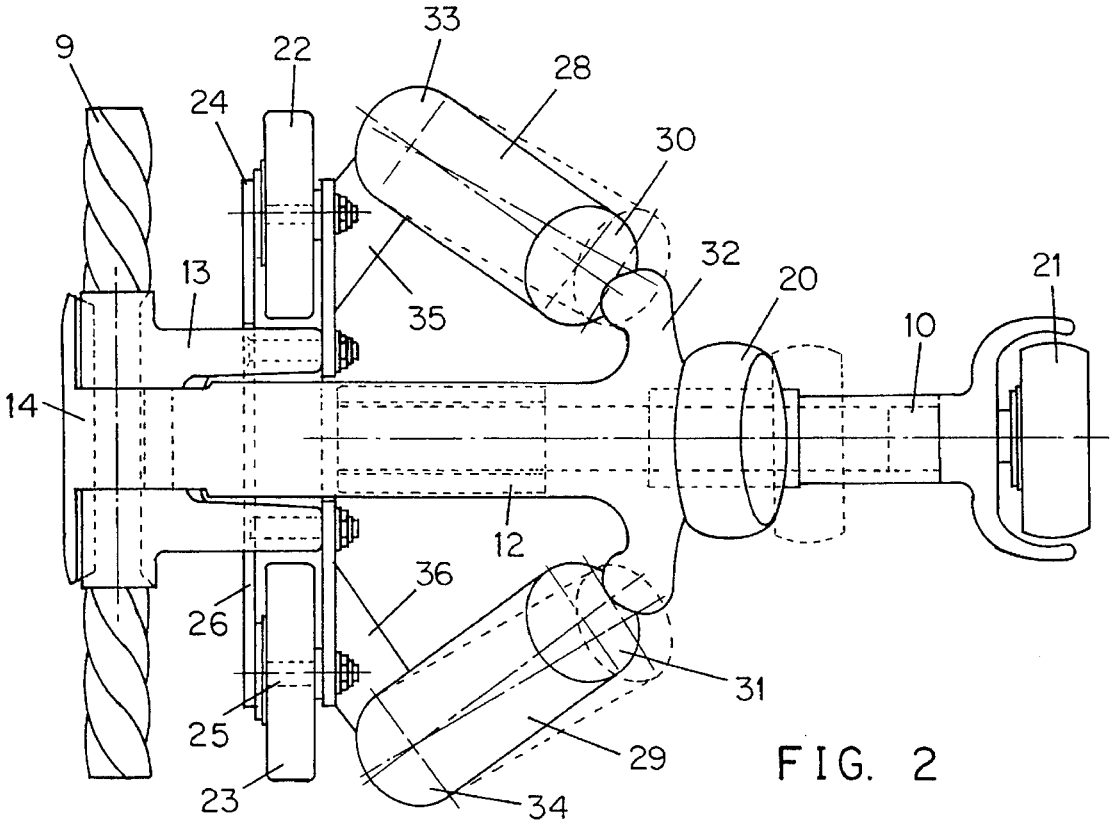
FIG. 2 is a plan view of the grip.

In the figures a detachable grip includes a lengthened grip body 10, extending transverselly on one side of the cable 9 when the grip is in the coupled position. The grip body 10 supports a bushing or articulation 11 of a load hanger 12. One end of the grip body 10 is provided with a stationary or fixed jaw 13 and with a spindle 15 which pivotally connects a movable jaw 14. In the cable clamping position of the jaws 13,14 the spindle 15 extends parallel and above the cable 9. One end 16 of an operating lever 17 is shaped so as to constitute the movable jaw 14, and the operating lever 17 extends and is able to pivot within a first plane, which contains the grip body 10 and corresponds to the plane of FIG. 1. The free end 18 of the operating lever 17, opposite to the movable jaw 14, supports on an axis 19 a roller 20, which travels along a guide rail (not shown) for opening or closing the jaws 13,14 in the stations. The grip body 10 further includes three support wheels 21,22,23 which are adapted to ride on tracks (not shown) which extend through the stations. One wheel 21 is rotatingly mounted on the free end of the grip body 10, opposite to the fixed jaw 13 and the two other wheels 22,23 are rotatingly mounted on the ends 24,25 of a transverse support bar 26 secured to the grip body 10. The support bar 26 is inserted between the fixed jaw 13 and the hanger 12 articulation 11, and extends in the direction of the cable 9. A friction plate 27 is secured to the upper side of the support bar 26, so as to cooperate with friction wheels (not shown) which provide braking and acceleration of the uncoupled grip in the stations. Such a grip is well known and it is not necessary to describe its working.

The operating lever 17 is urged towards the cable 9 clamping position, shown in the figures in full line, by a pair of coil compression springs 28,29, inserted between the operating lever 17 and the grip body 10. The two springs 28,29 are disposed symmetrically on opposite sides of the first plane, defined by the operating lever 17 and the grip body 10. The two springs 28,29 extend in a second plane, perpendicular to the first one, and inclined with respect to a direction of extension of the grip body 10. The upper ends 30,31 of the springs 28,29 are hinged by means of spherical joints 37 on a transverse arm 32 rigidly secured to the free end 18 of the operating lever 17. In a similar manner the lower ends 33,34 of the springs 28,29 are hinged near the ends 24,25 of the support bar 26 by means of spherical joints 37 and arms 35,36. The fixing points of the lower ends 33,34 are substantially at the level of the grip body 10 and they are sufficiently spaced for the housing of the hanger 12 with its articulation 11, between the two springs 28,29. The mutual distance of the upper ends 30,31 of the springs 28,29 is substantially smaller than the mutual distance of the lower ends 33,34 of the springs 28,29, and it is clear that the springs 28,29 are inclined in the first plane and in the second plane. The grip structure according to the invention brings together the grip parts, which support great forces, namely the jaws 13,14, the hanger 12, the support bar 26 and the lower ends 33,34 of the springs 28,29. The grip structure is compact and open, so that the movable parts cannot be clogged by ice or snow. The inclined position of the springs 28,29 changes the thrust exerted by the springs on the operating lever 17 and that inclination varies when the operating lever 17 pivots in the manner shown in dotted line on the figures.

What is claimed is:

1. A detachable grip for coupling loads to a cable of an aerial monocable transport installation, comprising:

a grip body for supporting a load hanger;

cable clamping jaws including a fixed jaw secured to the grip body and a moveable jaw pivotally mounted with respect to the fixed jaw;

a grip control mechanism including an operating lever having a first end portion secured to the moveable jaw to control opening and closing of the cable clamping jaws, and a free, second end portion, said operating lever being pivotal in a first plane which passes through the grip body; and first and second compression coil springs symmetrically disposed on lateral sides of the first plane, said compression coil springs extending between the second end portion of the operating lever and the grip body, said first and second compression coil springs extending along first and second axes, respectively, said first and second axes (i) lying in a second plane which is perpendicular to said first plane and which is inclined with respect to a direction of extension of the grip body, and (ii) being nonparallel and approaching each other toward said operating lever.

2. The detachable grip of claim 1, further comprising a support bar secured to the grip body adjacent the fixed jaw, each of the first and second compression coil springs having a first end connected to the support bar, and a second end connected to the second end portion of the operating lever, wherein the first ends are spaced apart from each other a distance greater than a distance that the second ends are spaced apart from each other.

3. The detachable grip of claim 2, further comprising grip support wheels rotatably supported by the support bar.

4. The detachable grip of claim 2, wherein said first ends of the compression coil springs are spaced apart from each other a distance sufficient to accommodate therebetween attachment of the load hanger to the grip body.

5. The detachable grip of claim 2, wherein said first ends of the compression coil springs are located in a plane which passes through the grip body.

* * * * *